US007270060B1

(12) United States Patent
Manole et al.

(10) Patent No.: US 7,270,060 B1
(45) Date of Patent: Sep. 18, 2007

(54) SLEEVE FOR STRUCTURALLY SUPPORTING A PENETRATOR OF A KINETIC ENERGY PROJECTILE

(75) Inventors: Leon Manole, Great Meadows, NJ (US); Stewart Gilman, Budd Lake, NJ (US); Ernest Logsdon, Newton, NJ (US); Daniel Vo, Landing, NJ (US)

(73) Assignee: United States of America as Represented by the Secretary of the Army, Washington, DC (US)

( * ) Notice: Subject to any disclaimer, the term of this patent is extended or adjusted under 35 U.S.C. 154(b) by 734 days.

(21) Appl. No.: 10/605,057

(22) Filed: Sep. 5, 2003

Related U.S. Application Data

(60) Provisional application No. 60/320,162, filed on May 5, 2003.

(51) Int. Cl.
*F42B 14/06* (2006.01)

(52) U.S. Cl. ..... 102/521; 102/520

(58) Field of Classification Search ..... 102/521, 102/520

See application file for complete search history.

(56) References Cited

U.S. PATENT DOCUMENTS 4,704,968 A * 11/1987 Davis, Jr. ..... 102/517
4,759,293 A * 7/1988 Davis, Jr. ..... 102/520
5,196,650 A * 3/1993 Cytron ..... 102/521
5,408,932 A * 4/1995 Hesse et al. ..... 102/501
6,581,522 B1 * 6/2003 Julien et al. ..... 102/431

* cited by examiner

*Primary Examiner*—Michael J. Carone
*Assistant Examiner*—Gabriel J. Klein
(74) *Attorney, Agent, or Firm*—Michael C. Sachs; John F. Moran

(57) ABSTRACT

A rod sleeve made of smart material sleeves and/or steel sleeves with smart material rings surrounds the rod of a kinetic energy projectile. The rod may be made of DU, tungsten, or other material. Smart materials are materials such as nickel-titanium (nitinol) and copper aluminum nickel (CAN) that can be trained to change to one or more particular shapes at predetermined temperatures. The change in shape occurs on a molecular level, almost instantaneously. The rod sleeve can be made all or in part from smart material. The smart material is trained to shrink at cold temperatures and expand at hot temperatures. The sleeve may then be heated and expanded to allow the sleeve to be pressed on the rod. As the sleeve cools, it compresses and provides required support to rod during gun launch of the kinetic energy projectile. The sleeve heats up while traveling down range due to the aero-ballistic heating of the sleeve material. At this higher temperature, the sleeve expands. Upon projectile impact with the target, the sleeve minimally penetrates the target, allowing the rod to slip supported through the sleeve and penetrate the target. The sleeve supports the rod as it penetrates the target but does not inhibit its penetration, remaining behind as the rod continues to penetrate the target.

18 Claims, 5 Drawing Sheets

SLEEVE FOR STRUCTURALLY SUPPORTING A PENETRATOR OF A KINETIC ENERGY PROJECTILE

FEDERAL RESEARCH STATEMENT

The invention described herein may be manufactured and used by or for the Government of the United States for governmental purposes without payment of any royalties thereon.

BACKGROUND OF INVENTION

The present invention generally relates to the field of military ordinance. In particular, it relates to a sleeve for supporting a Kinetic Energy (KE) penetrator rod to increase the rods armor defeat capabilities.

Tactical KE projectiles are well known in the ammunition community and are made in small, medium and large caliber from 20 to 120 mm. FIG. 1 illustrates a cross sectional view of KE projectile 10. The KE projectile 10 is comprised of a sabot 15, rod 20 (also referenced as a penetrator or projectile rod 20), a nose 25, and a fin 30.

The sabot supports the penetrator rod and is typically made of three pieces or petals that are discarded from the rod as soon as the projectile exits the gun tube and moves past the gun gases.

The projectile rod 20, nose 25, and fin 30 are known as the in-flight projectile. The fin and nose provide stability during flight of the KE projectile. The penetrator or projectile rod is what defeats the target. When the sabot is attached to the in-flight components the projectile is known as the in-bore projectile. A retaining ring (not shown) is imbedded in the front and back of the sabot. This retaining ring holds the petals of the sabot together.

When the projectile is launched from the gun tube, the scoop in front of the sabot captures air and a force is applied to the sabot sections. When the force exerted by the air exceeds the strength of the retaining rings, the retaining ring breaks, allowing the petals of the sabot to come apart and move away from the in-flight projectile. After the sabot is discarded, the in-flight projectile travels on to the target. The target is typically protected with heavy armor.

The projectile rod penetrates or defeats (i.e., when the penetrator rod completely penetrates the armor) the target utilizing the very high velocity (kinetic energy) at which the rod is traveling. An increase in projectile rod velocity increases the armor thickness that the rod can penetrate.

Numerous conventional rods are made of Depleted Uranium (DU) or Tungsten. These penetrators offer the best target penetration compared to other materials due to their material properties. However, rods made of DU and Tungsten may create environmental problems due to their ability to leach toxic materials into the ground. In addition, rods made of DU and tungsten are extremely heavy, reducing the velocity achievable by the KE projectile.

There is a relationship of the weight of the projectile rod, weight of the in-bore projectile, length of the projectile rod, velocity of the projectile rod, material of the rod and the ability of the rod to defeat armor of various thickness. The heavier the rod the heavier the projectile and slower the in-flight projectile can be launched. Higher velocities for a given length, diameter of a DU or Tungsten rod will defeat thicker armor.

For a given diameter and velocity a longer DU or Tungsten projectile rod usually will defeat thicker armor given that it is not to long and begins to bow excessively in flight.

The designer of a KE rod therefore tries to balance the projectile weight, diameter, length and material to get a KE rod that will defeat the thickest armor threats (enemy vehicles). Currently US Army engineers are looking for better KE projectile designs that can penetrate or defeat future enemy armor which will be extremely thick.

What is needed is a method for reducing the diameter of the rod, thus reducing the volume of DU or Tungsten in the rod without affecting the penetration capability. This will reduce the weight of the KE rod while increasing the velocity and kinetic energy. In addition, this will reduce the amount of DU or tungsten that is in the penetrator rod and therefore decrease the environmental impact. This new design should provide adequate structural support of the KE projectile during flight and target impact. The need for such a system has heretofore remained unsatisfied.

SUMMARY OF INVENTION

The rod sleeve of the present invention satisfies this need. The present invention uses shape memory alloy (also known as smart materials in the industry), sleeves and/or steel or composite sleeves with shape memory alloy rings to surround the penetrator rod. The penetrator rod may be made of DU or tungsten. Shape memory alloys or smart materials are materials such as Nickel-Titanium (nitinol) or Copper Aluminum Nickel (CAN) that can be trained to change to one or more particular shapes at predetermined temperatures. The change in shape occurs on a molecular level, almost instantaneously. The change in shape can be performed thousands of times without affecting the shape memory alloy's ability to do work or complete the shape change. Reference is made to U.S. Pat. No. 6,371,030.

Providing a sleeve for the DU or Tungsten penetrator rod of the KE projectile allows a decrease in the diameter of the penetrator rod without changing the length of the rod. This occurs because the shape memory alloy or steel or composite sleeve provides the desired structural integrity to the DU or tungsten penetrator rod needed to survive the forces of gun launch. The penetrator rod with the sleeve is part of the overall projectile and is a major support component of the entire projectile. A standard DU or Tungsten penetrator rod will have the same outer diameter as a DU or Tungsten penetrator with a sleeve.

The DU or Tungsten penetrator rod with a sleeve is lighter, consequently the KE projectile is lighter since the sleeve material is significantly lighter than the penetrator rod material (for example, DU or tungsten) that the sleeve replaces. Because the KE projectile is lighter, the velocity of the KE projectile is higher given the same gun pressure to the KE projectile when fired from the gun. Given the same in-flight drag profile for a monolithic KE penetrator rod, higher velocities at gun muzzle translate to higher velocities at target impact and increased penetration. This assumes sabot discard is always normal.

The penetrator rod sleeve of the present invention can be made all or in part from shape memory alloy. Shape memory alloy can be trained to expand at a specific hot (expansion) temperature and to shrink at a cooler (or contraction) temperature. This could be implemented during a special heat treat process commonly used in the industry.

The shape memory alloy sleeve may then be heated and expanded to allow the sleeve to be pressed or slid over the penetrator rod. As it cools, the sleeve compresses and provides required support to the rod during gun launch of the KE projectile. After gun launch, the sleeve heats up while traveling down range due to the aero-ballistic heating of the sleeve material. At this higher temperature, the sleeve expands and a gap is formed between the penetrator rod and sleeve. Upon projectile impact with the target, the sleeve minimally penetrates the target, allowing the rod to slip supported through the sleeve and penetrate the target. The sleeve supports the penetrator rod as it penetrates the target and does not inhibit but enhances its penetration, remaining behind as the rod continues to penetrate the target.

The introduction of the sleeve to the design of the penetrator rod of the KE projectile lightens the KE projectile, allowing achievement of greater KE projectile velocities. This, in addition to the additional support at target impact, that the sleeve provides to the DU or Tungsten penetrator rod, allows the KE rod to have even greater penetration and therefore defeat thicker armor than conventional KE projectiles.

Several types of shape memory alloy sleeves or steel sleeves segments held together with shape memory alloy rings could be used in the implementation of the present invention.

In one embodiment of the invention, a complete shape memory alloy cylinder is used to support the DU or Tungsten Penetrator rod. To attach this sleeve to the penetrator rod, the sleeve is heated to the value to where the shape memory alloy has been trained to expand. The sleeve is then slid over the penetrator rod which has a nose and fin attached.

Upon cooling the shape memory alloy sleeve returns to its original diameter and clamps onto the DU or Tungsten penetrator rod. This provides all the support the rod needs to survive shot start and the ballistic event. Standard threads or buttress grooves are located on the outer diameter of the sleeve and allow attachment of the sabots to the sleeve. This attachment method is normal to the building of all KE sabot type projectiles.

After sabot attachment, a standard plastic obturator is slid onto the rear of the sabots. This completes the in-bore projectile. Upon shot start and throughout the travel of the projectile through the gun tube, the sleeve remains tight on the penetrator rod providing the support it needs. Upon muzzle exit the obturator breaks into pieces, the sabot petals come apart and are discarded and the in-flight projectile travels on to the target.

As the in-flight projectile travels to the target, aerodynamic heating (up to 700 degrees F) takes place on the projectile and the sleeve expands to its maximum diameter providing a loose fit between the penetrator rod and sleeve. When the in-flight projectile hits the intended target the loose sleeve provides a support to the penetrator rod, allowing the rod to penetrate deeper into the target, while at the same time the sleeve achieves only minimal penetration. Therefore, the sleeve has contributed twice to the ability of the penetrator rod to achieve deeper penetration. The sleeve allows a faster velocity to the projectile and provides a sleeved support to the penetrator upon impact with the target.

In a second embodiment of the invention, the shape memory alloy Sleeve is a cylinder with an axial slot in it. This allows for larger movement of the shape memory alloy sleeve in the radial direction since the sleeve can move from a cylindrical shape to a flat shape if needed. The slotted sleeve can therefore be trained to be loose at a hot temperature and tight at a cooler temp. This provides ease of assembly. Following aerodynamic heating the sleeve expands and provides a loose support, at target impact, so that the penetrator rod can slide easily through the sleeve into the target. This sleeve performs the same as the cylindrical sleeve without the slot, except it has the ability to allow for more room between the penetrator rod and sleeve after aerodynamic heating. This helps ensure the projectile will slide easier from the sleeve into the target.

In a third embodiment of the invention, the sleeve is a metal or plastic composite cylinder comprised of three segments that are held together by a shape memory alloy ring at each end of the sleeve. The ring is trained to expand at a given hot temperature and contract at a colder temperature (i.e. expand at 200 F and contract at 150 F).

The shape memory alloy rings are heated (in this case to 200 F or greater) and expand and are placed on both ends of the sleeve. The rings contract, as they cool (in this case 150 F and below) and hold the steel segments or composite segments tightly together and press fits the sleeve segments to the rod.

There are standard buttress grooves or threads on the outer diameter of the sleeve that the sabot attaches to as in any standard KE projectile. The sabot petals are attached to the sleeve and standard force retaining rings are added to hold the sabots together.

A plastic obturator is attached to the rear of the sabot to complete the in-bore projectile assembly. The sleeve fully supports the projectile rod during the ballistic event in the gun tube. Upon muzzle exit the sabot and obturator come apart, as aforementioned, and the in-flight projectile travels downrange to the target.

As the projectile travels to the target the shape memory alloy rings, on the sleeve, experience aerodynamic heating and expand causing the sleeve sections to be a loose fit with the penetrator rod. When the in-flight projectile hits the intended target the loose sleeve provides a support to the penetrator rod allowing the rod to penetrate deeper into the target while at the same time the sleeve achieves only minimal penetration.

The introduction of a sleeve to the KE projectile design provides better target defeat capabilities for DU and tungsten rods.

BRIEF DESCRIPTION OF DRAWINGS

The various features of the present invention and the manner of attaining them will be described in greater detail with reference to the following description, claims, and drawings, wherein reference numerals are reused, where appropriate, to indicate a correspondence between the referenced items, and wherein:

It should be understood that the sizes of the different components in the figures are not necessarily in exact proportion or to scale, and are shown for visual clarity and for the purpose of explanation.

DETAILED DESCRIPTION

Figure 1:
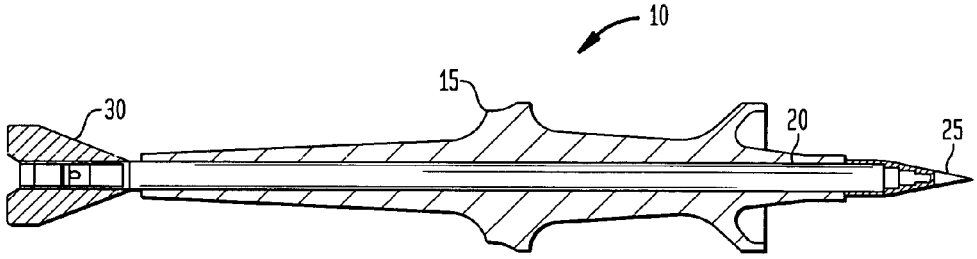
FIG. 1 (PRIOR ART)
FIG. 1 is a cross-sectional, side view of a Kinetic Energy (KE) projectile with standard sabot (in-bore projectile, obturator not shown) using a prior art design.

FIG. 1 is a cut-away profile view of a conventional kinetic energy tactical projectile 10 using a standard sabot 15. The kinetic energy tactical projectile 10 is comprised of a sabot 15, a projectile rod 20, a nose 25, and a fin 30 (known as the in-bore projectile).

Figure 2:
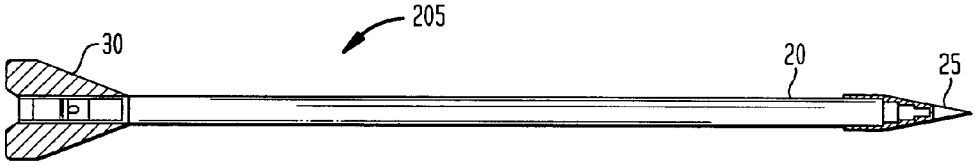
FIG. 2 (PRIOR ART)
FIG. 2 is a cross-sectional, side view of the rod, nose, and fin of a kinetic energy projectile (in-flight projectile) using a prior art design.

FIG. 2 is a cut-away profile view of a conventional in-flight projectile 205 after the sabot 15 has been discarded, illustrating the prior art design of the rod 20. The rod 20 is the only component of the kinetic energy tactical projectile 10 that does the work of penetrating the target; consequently, the fin 30, the nose 25, and the sabot 15 are parasitic weight.

Figure 3:
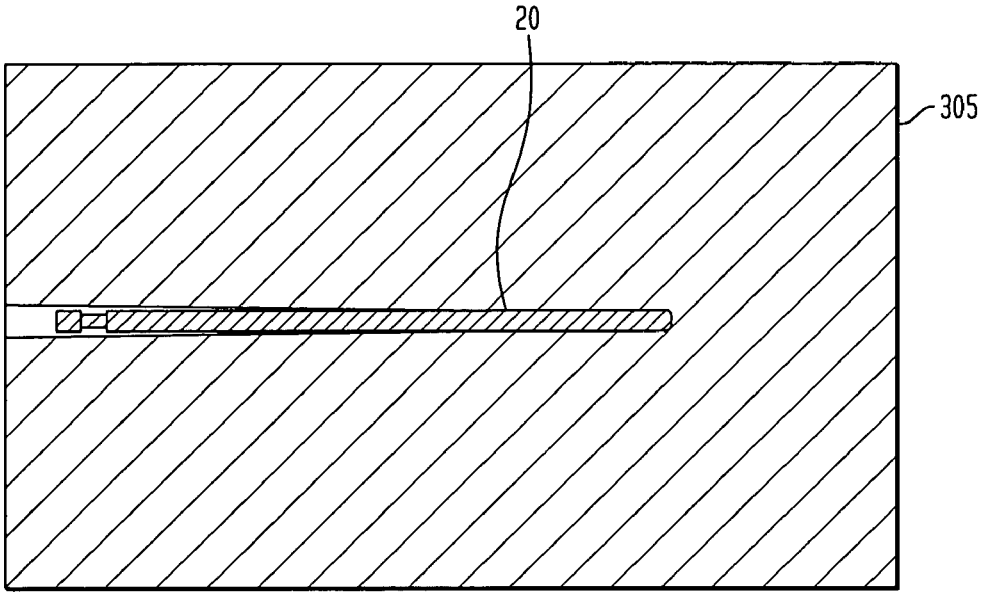
FIG. 3 (PRIOR ART)
FIG. 3 is a diagram illustrating penetration of a target by a kinetic energy projectile using a prior art design.

FIG. 3 illustrates the conventional in-flight projectile 205 penetrating an armored target 305. After impacting the armor of the armored target 305, the rod 20 penetrates the armored target 305 due to its velocity. Factors that determine the depth of penetration of the armored target 305 by the rod 20 comprise characteristics of the rod 20, impact velocity, impact angle, and the material of which the armored target 305 is made. Characteristics of the rod 20 affecting depth of penetration of the armored target 305 comprise material, length, and outer diameter. The armored target 305 is known as "defeated" if the rod 20 passes completely through the armored target 305.

Figure 4A:
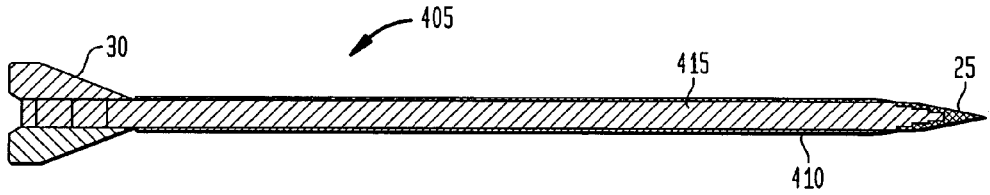
FIG. 4 is comprised of FIGS. 4A, 4B, and 4C and represents a partially exploded view of an in-flight kinetic energy projectile utilizing a sleeve made of shape memory alloy material.
Figure 4B:
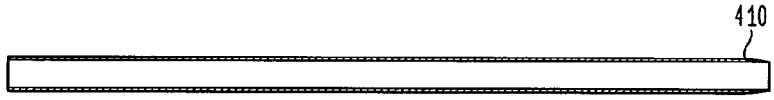
Figure 4C:
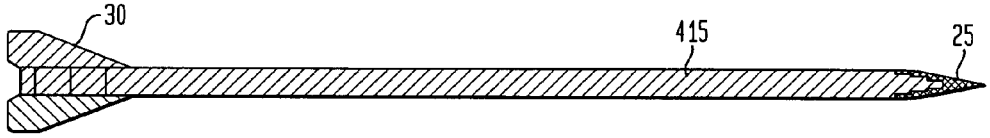

FIG. 4 (FIGS. 4A, 4B, 4C) illustrates an in-flight projectile 405 with a rod sleeve 410 that surrounds a rod 415. The rod 415 may be made of depleted uranium, tungsten, or other material. The in-flight projectile 405 also comprises a nose 25 and fin 30. The rod sleeve 410 is comprised of materials known as shape memory alloy or "smart" materials. Shape memory alloys are materials such as nickel-titanium (nitinol) or copper aluminum nickel (CAN) that can be trained to change to one or more particular shapes at predetermined temperatures. The change in shape occurs on a molecular level, almost instantaneously. The change in shape can be performed thousands of times without affecting the shape memory alloy's ability to do work or complete the shape change.

The shape memory alloy material used in the rod sleeve 410 is trained to expand at hot temperatures and shrinks at cooler temperatures. For example the sleeve could be trained to expand to its maximum outer diameter at temperatures of 200 F or greater and contract to its minimum diameter as it cools to below 150 F. The training of the shape memory alloy is a term used in industry to denote the heat treatment process used in industry to get the shape memory alloy to take a particular shape at a particular temperature. During manufacture and assembly of the kinetic energy projectile, the rod sleeve 410 is heated (i.e. in this case to 200 F or above) and expanded to allow the rod sleeve 410 to be pressed or slid onto the rod 415. As the rod sleeve 410 cools (i.e. in this case to 150 F or below), it compresses and provides the required support to rod 415 during gun launch of the kinetic energy projectile.

Figure 5:
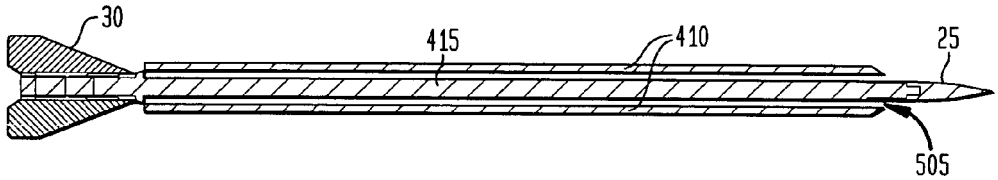
FIG. 5 is a diagram illustrating a gap that forms between the sleeve and rod of FIG. 4 during flight of the in-flight kinetic energy projectile.

The rod sleeve 410 heats up during flight due to the aerodynamic heating of the material of the rod sleeve 410. At this higher temperature, the rod sleeve 410 expands as shown in FIG. 5, creating a small gap 505 between the rod sleeve 410 and rod 415. The gap 505 is not to scale in FIG. 5, and is shown for exemplary purposes only.

Figure 6:
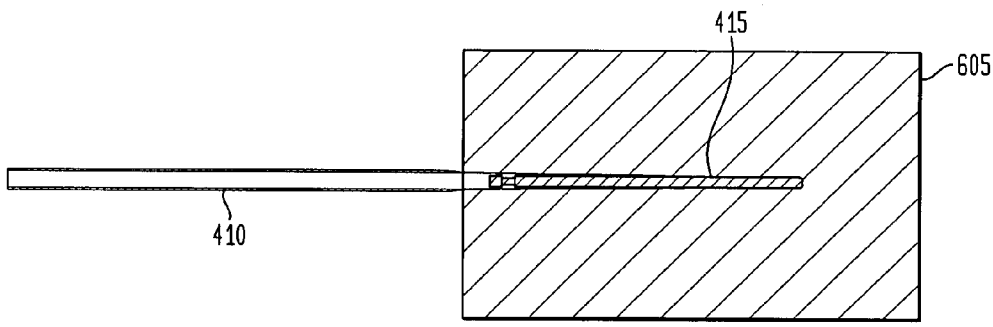
FIG. 6 is a diagram illustrating penetration of a target by the KE rod of FIG. 4 and illustrates the sleeve achieves minimal penetration.

FIG. 6 illustrates impact of a target 605 by the in-flight projectile 405 (shown in FIG. 4A). Upon impact with the target, the rod sleeve 410 minimally penetrates the target. Supported by the rod sleeve 410, the rod 415 slips through the rod sleeve 410 and penetrates the target. Due to gap 505 (FIG. 5), the rod sleeve 410 supports the rod 415 as it penetrates the target but does not inhibit its penetration, remaining behind as the rod 415 penetrates the target. Once past the rod sleeve 410, the rod 415 continues to penetrate the target 605.

Figure 7:
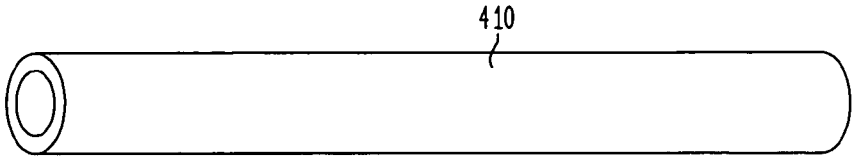
FIG. 7 is a diagram illustrating the design of an embodiment of the sleeve of FIG. 4.

FIG. 7 illustrates an embodiment of a rod sleeve 410 constructed as a hollow cylinder made of shape memory alloy, sized to fit the rod 415. The shape memory alloy of the rod sleeve 410 is trained to expand at hot temperatures and to shrink at colder temperatures. The rod sleeve 410 is heated, allowing the rod sleeve 410 to expand sufficiently to be slid onto the rod 415. As the rod sleeve 410 cools, it tightly compresses the rod 415, providing structural support of the rod 415 during launch and flight.

Figure 8:
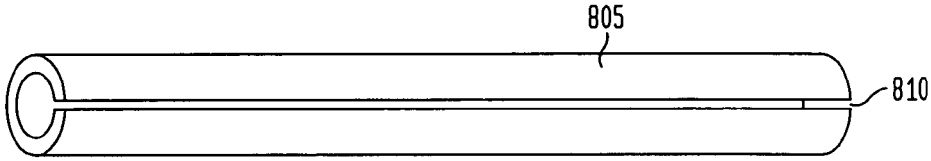
FIG. 8 is a diagram illustrating the design of an embodiment of the sleeve of FIG. 4 utilizing a slot along the length of the sleeve.

FIG. 8 illustrates another embodiment of the rod sleeve 805. Rod sleeve 805 is constructed as a cylinder of shape memory alloy with a slot 810 along the length of the cylinder. Slot 810 is introduced for ease of construction and assembly. Shape memory alloy may be manufactured as a sheet and then shaped into a cylinder by standard manufacturing technique. The slotted cylinder may then be trained to have different inner diameters at different temperatures. At hot it may be trained to have a inner diameter to allow the sleeve 805 to easily slide onto penetrator rod 415. At a cooler temperature the sleeve 805 may be trained to shrink to a pressed fit on rod 415.

Figure 9A:
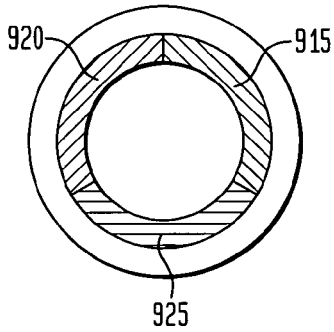
FIG. 9 is comprised of FIGS. 9A and 9B, and represents a diagram illustrating the design of an embodiment of the sleeve of FIG. 4 utilizing shape memory alloy material rings to hold together a segmented sleeve made of alternative materials such as metal and plastic composites.
Figure 9B:
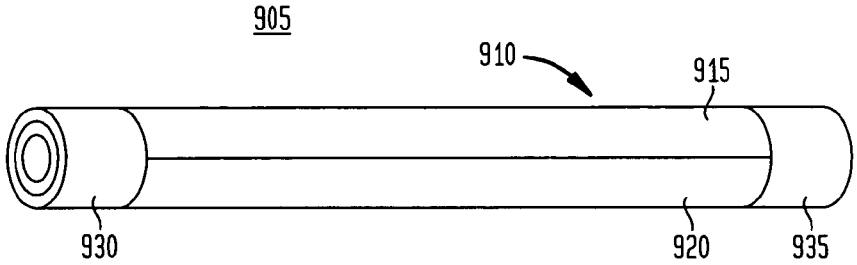

FIG. 9 (FIGS. 9A and 9B) illustrates a further embodiment of the rod sleeve 905. Rod sleeve 905 is comprised of a sub-rod sleeve 910 comprised of a hollow cylinder segmented along the length of the rod. The sub-sleeve 910 is made of a material such as steelor plastic composites rather than a shape memory alloy. As shown in the exemplary cross-section of rod sleeve 905 in FIG. 9A, the sub-sleeve 910 is comprised of segments 915, 920, 925 (the rod can be more than 3 segments if needed) At each end of the rod sleeve 905, rings 930, 935 are placed over the sub-sleeve 910. These rings may be placed in the center of the rod sleeve (lengthwise) or at any other positions along the length of the sub-sleeve, if needed. Rings 930, 935 are made of shape memory alloy. The shape memory alloy of the rings 930, 935 is trained to expand at hot temperatures and shrink at cooler temperatures by a heat treatment process commonly done in industry.

During manufacture and assembly of the kinetic energy projectile, the rings 930, 935 are heated, allowing the rings 930, 935 to expand sufficiently to be slid onto the sub-sleeve 910. As rings 930, 935 cool, they tightly compress the sub-sleeve 910 against the rod 415 (shown in FIG. 4), providing structural support of the rod 415 during launch and flight. The rings 930, 935 hold the sub-sleeve 910 tightly against the rod 415 until aerodynamic heating causes the rings 930, 935 to expand. This loosens the sub-sleeve 910 enough to allow the rod 415 to freely pass through the rod sleeve 905 when a target is impacted. Slotted rings of shape memory alloy may also be used in place of the rings 930 and 935.

It is to be understood that the specific embodiments of the invention that have been described are merely illustrative of certain applications of the principle of the present invention. Numerous modifications may be made to the method for structurally supporting the rod of a kinetic energy projectile invention described herein without departing from the spirit and scope of the present invention.

What is claimed is:

1. A kinetic energy projectile comprising:

a penetrator;

a sleeve composed of a shape memory alloy that is thermally shrunk around the penetrator;

the sleeve capable of heating up during flight, and expanding to form a separation between the sleeve and the penetrator; and wherein upon target impact, the sleeve only minimally penetrates the target and allows the penetrator to slide through the sleeve into the target, thus enhancing the target penetration capability of the penetrator.

2. The projectile of claim 1, further comprising a nose assembled to a front end of the penetrator.

3. The projectile of claim 2, further comprising a fin assembled to a rear end of the penetrator.

4. The projectile of claim 3, further comprising a sabot secured to the sleeve.

5. The projectile of claim 4, further comprising a retaining ring that holds the sabot together.

6. The projectile of claim 5, further comprising an obturator that is secured to the sabot.

7. The projectile of claim 1, wherein the shape memory alloy of the sleeve is trained to fit an outer diameter of the penetrator at a specific expansion temperature and contract at a specific contraction temperature to provide support to the penetrator during launch of the kinetic energy projectile.

8. The projectile of claim 7, wherein the shape memory alloy of the sleeve is trained to expand at a specific expansion temperature and contract at a specific contraction temperature that is cooler than the expansion temperature.

9. The projectile of claim 8, wherein the shape memory alloy of the sleeve is trained to be slightly larger than the penetrator at the expansion temperature to allow the penetrator to slide through the sleeve and to penetrate a target without the sleeve.

10. The projectile of claim 8, wherein the sleeve is provided with a slot along the length of the sleeve for ease of manufacturing, and ease of expansion when the projectile is subjected to aerodynamic heating, and ease of contraction when the projectile is subjected to the contraction temperature.

11. The projectile of claim 1, wherein the sleeve comprises a sub-sleeve that is secured together by a plurality of rings.

12. The projectile of claim 11, wherein the sub-sleeve is comprised of a hollow cylinder that is segmented into a plurality of sections along a circumference of the hollow cylinder.

13. The projectile of claim 12, wherein the sub-sleeve is made of steel.

14. The projectile of claim 12, wherein the sub-sleeve is made of a plastic composite.

15. The projectile of claim 11, wherein the rings are comprised of the shape memory alloy.

16. The projectile of claim 15, wherein the rings comprise a slotted ring.

17. The projectile of claim 15, wherein the shape memory alloy of the rings is trained to fit an outer diameter of the sub-sleeve at the contraction temperature, to compress the sub-sleeve and to provide support to the penetrator during the launch of the kinetic energy projectile.

18. The projectile of claim 15, wherein the shape memory alloy of the rings is trained to be slightly larger than an outer diameter of the sub-sleeve at the expansion temperature to allow the penetrator to slide through the sleeve and to penetrate a target with minimal penetration of the sleeve.

* * * * *